United States Patent [19]

Slaney

[11] Patent Number: 4,795,504

[45] Date of Patent: Jan. 3, 1989

[54] NICKEL-COBALT BASE ALLOYS

[75] Inventor: John S. Slaney, Greensburg, Pa.

[73] Assignee: Latrobe Steel Company, Latrobe, Pa.

[21] Appl. No.: 893,634

[22] Filed: Aug. 6, 1986

Related U.S. Application Data

[63] Continuation of Ser. No. 638,985, Aug. 8, 1984, abandoned.

[51] Int. Cl.[4] ..... C22C 19/05

[52] U.S. Cl. ..... 148/410; 148/12.7 R; 148/12.7 N; 148/419; 148/427; 148/442

[58] Field of Search ..... 148/408, 410, 419, 425, 148/427, 442, 12.7 R, 12.7 N; 420/586, 585, 588, 442, 451, 454, 459, 436, 439, 440

[56] References Cited

U.S. PATENT DOCUMENTS 3,356,542 12/1967 Smith ..... 148/32.5

3,767,385 10/1973 Slaney ..... 75/122

*Primary Examiner*—R. Dean

*Attorney, Agent, or Firm*—Curtis, Morris & Safford

[57] ABSTRACT

A work hardened nickel-cobalt alloy having high strength and ductility at temperatures of about 1300° F. is provided consisting essentially by weight of about 0.05% max carbon, about 20%–40% cobalt, about 6%–11% molybdenum, about 15%–23% chromium, about 1.0% max iron, about 0.0005%–0.020% boron, about 0%–4% titanium, about 0%–2% columbium and the balance nickel, the alloy having been cold worked at a temperature below the HCP-FCC phase transformation zone to a reduction in cross-section between 5% and 50%.

15 Claims, No Drawings

NICKEL-COBALT BASE ALLOYS

This is a continuation of application Ser. No. 639,985, filed Aug. 8, 1984, abandoned.

This invention relates to nickel-cobalt base alloys and particularly nickel-cobalt base alloys having excellent corrosion resistance combined with high strength and ductility at higher service temperatures.

There has been a continuing demand in the metallurgical industry for alloy compositions which have excellent corrosion resistance combined with high strength and ductility at higher and higher service temperatures.

The Smith patent, U.S. Pat. No. 3,356,542, issued Dec. 5, 1967, discloses cobalt-nickel base alloys containing chromium and molybdenum. The alloys of the Smith patent are corrosion resistant and can be work strengthened under certain temperature conditions to have very high ultimate tensile and yield strength. These alloys can exist in one of two crystalline phases, depending on temperature. They are also characterized by a composition-dependent transition zone of temperatures in which transformation between phases occur. At temperatures above the upper transus, the alloy is stable in the face centered cubic (FCC) structure. At temperatures below the lower transus, the alloy is stable in the hexagonal close-packed (HCP) form. By cold working metastable face centered cubic material at a temperature below the lower limit of the transformation zone, some of the alloy is transformed into the hexagonal close-packed phase which is dispersed as platelets through the matrix of face centered cubic material. It is this cold working and phase transformation which appears to be responsible for the excellent ultimate tensile and yield strength of the alloy of the Smith patent. The alloy is further strengthed by precipitation hardening. This alloy, however, has stress rupture properties which make it not suitable for temperatures above about 800° F.

In my earlier U.S. Pat. No. 3,767,385 I provide an alloy which is an improvement on the Smith patent and which has stress rupture properties suitable for service temperatures to about 1100° F. In that patent I disclosed my discovery that modifying the Smith composition by including elements which I believe form compounds resulting in additional precipitation hardening of the alloy, supplementing the hardening effect due to conversion of FCC to HCP phase, made it possible to provide higher tensile strength and ductility with a lower amount of cold work. This in turn raised the tensile strength and ductility level at higher temperatures. However, above 1100° F. neither the alloy of Smith nor the alloy of my earlier patent will provide the thermomechanical properties of the present alloy.

The alloy of the present invention provides an alloy which retains satisfactory tensile and ductility levels and stress rupture properties at temperatures up to about 1300° F. This is a striking improvement in thermomechanical properties and is accomplished by modifying the composition so that the transus is raised to higher temperatures and the precipitation hardening effect is maximized. Thus, the iron and aluminum are reduced to incidental proportions, and titanium or columbium or both are increased to limits described below. Accordingly, as pointed out in my earlier patent, not all alloys whose composition falls wtihin the ranges set out herein are encompassed by the present invention, since many of such compositions would include alloys containing embrittling phases.

The formation of these embrittling phases in the transition elements bears a close relationship to the electron vacancies in their sub bands as was predicted by Linus Pauling many years ago ("The Nature of Interatomic Forces in Metals", Physical Review, vol. 54, Dec. 1, 1938). Paul Beck and his coworkers (S. P. Rideout and P. A. Beck, NASA TN 2683) showed how the formation of pure sigma phase in ternary alloys could be related to the atomic percentages of their constituent elements by a formula of the type:

$$N_v = 0.61Ni + 1.71CO + 2.66Fe + 4.66Cr + 5.66Mo$$

where $N_v$ is the average number of electron vacancies per 100 atoms of the alloy and the chemical symbols refer to the atomic fraction of that element in the alloy. There is a critical $N_v$ number above which 100% of sigma can be expected to form. In engineering alloys however, the presence of a small amount of the sigma phase can render an alloy brittle. The first onset of sigma can be predicted at a lower $N_v$ number which varies with different alloys. In my earlier U.S. Pat. No. 3,767,385 I describe this variation with the percentage of iron in the alloy. However, in the present alloy, a limit of only 1% iron is imposed and so only one critical $N_v$ number is specified, namely 2.80.

The calculation of the number uses the above formula except that the chemical symbol refers to the "effective atomic fraction" of the element in the alloy. This concept takes into account the postulated conversion of a portion of the metal atoms present, particularly nickel, into compounds of the type Ni3X, where X is titanium, columbium or aluminum. These compounds precipitate out of solid solution thus altering the composition of the remaining matrix to reduce the amount of nickel and effectively to increase the amount of the other transition elements. Thus, the remaining composition has an "effective atomic fraction" of these elements. Consequently many combinations of all the interacting elements can produce the same $N_v$ number (small effects on the $N_v$ due to carbon and boron are not significant and may be ignored in these calculations) Thus, the maximum of titanium when used without columbium and using the preferred analysis is 6%. Similarly, the maximum for columbium without titanium is 10%. Either titanium or columbium may be used in this alloy, alone or in combination, but must be used so that the resulting $N_v$ number does not exceed 2.80. The alloy of this invention, like those of Smith and my earlier patent is a multiphase alloy forming an HCP-FCC platelet structure.

The alloys of the present invention broadly comprise the following chemical elements in the indicated weight percentage ranges:

| | | | |
|---|---|---|---|
| Carbon | 0.05 max | Cobalt | 20–40 |
| Molybdenum | 6–11 | Chromium | 15–23 |
| Iron | 1.0 max | Boron | 0.005–0.020 |
| Titanium | 0–6 | Columbium | 0–10 |
| Nickel | Bal. | | |

The preferred aim analysis for melting the alloy of the invention is, in weight percent:

| | | | |
|---|---|---|---|
| Carbon | 0.01 max | Cobalt | 36 |
| Molybdenum | 7.5 | Chromium | 19.5 |

-continued

| | | | |
|---|---|---|---|
| Iron | 1.0 max | Boron | 0.01 |
| Titanium | 3.8 | Columbium | 1.1 |
| Nickel | Bal. | | |

The alloy of this invention is melted by any appropriate technique such as vacuum induction melting and cast into ingots or formed into powder for subsequent formation into articles by any appropriate known powder metals technique. After casting as ingots, the alloy is preferably homogenized and then hot rolled into plates or other forms suitable for subsequent working.

The alloy is preferably finally cold worked at ambient temperature to a reduction of cross section of at least 5% and up to about 40%, although higher levels of cold work may be used but with some loss of thermomechanical properties. It may, however, be cold worked at any temperature below the HCP-FCC transformation zone.

After cold working the alloys are preferably aged at a temperature between 800° F. and 1350° F. for about 4 hours. Following aging the alloys may be air cooled.

The unique properties and advantages of the alloy of this invention can perhaps be best understood by referring to the following examples:

EXAMPLE

An alloy composition according to this invention was prepared having the composition by weight:

| C | Co | Mo | Cr | Fe | B | Ti | Cb | Ni |
|---|---|---|---|---|---|---|---|---|
| 0.006% | 36.3% | 7.35% | 19.4% | 1.04% | 0.008% | 3.79% | 1.20% | BAL |

This alloy was hot rolled and divided into two portions one of which was cold worked to 36% and the other to 48%, aged at 1300° F. and formed into test pieces identified by the terms "specimens" which are plain, cylindrical test specimens and "studs" which are threaded test specimens.

These specimens were subjected to mechanical testing at elevated temperatures as set out in Tables I, II and III hereafter.

TABLE I

| TEST Temp. °F. | STRESS, ksi | AREA in$^2$ | STEEL TEST | Aged 1300° COLD WORK | t hrs | log t | T/1000 | P (C = 20) | pl (C = 25) |
|---|---|---|---|---|---|---|---|---|---|
| 1350 | 105.0 | .06397 | 5/16" Studs | 36 | 11.2 | 1.0492 | 1.81 | 38.0991 | 47.1491 |
| | 73.0 | | | | 105.6 | 2.0237 | | 39.8628 | 48.9128 |
| 1300 | 96.0 | | | | 79.1 | 1.0982 | 1.76 | 38.5408 | 47.3408 |
| 1200 | 150.0 | | | | 83.0 | 1.9191 | 1.66 | 36.3857 | 44.6857 |
| | 141.5 | | | | 75.9 | 1.8802 | | 36.3212 | 44.6612 |
| 1350 | 105.0 | .09506 | ⅜" Studs | 36 | 15.3 | 1.1847 | 1.81 | 38.3443 | 47.3943 |
| | 73.0 | | | | 103.4 | 2.0145 | | 39.8463 | 48.8963 |
| 1300 | 96.0 | | | | 98.2 | 1.9921 | 1.76 | 38.7061 | 47.5061 |
| | 61.1 | | | | 1035.7 | 3.0152 | | 40.5068 | 49.3068 |
| | 150.0 | | | | 2.9 | 0.4624 | | 36.0138 | 44.8138 |
| 1200 | 160.5 | | | | 22.0 | 1.3424 | 1.66 | 35.4284 | 43.7284 |
| | 150.0 | | | | 62.2 | 1.7938 | | 36.1777 | 44.4777 |
| | 141.5 | | | | 99.4 | 1.9974 | | 36.5157 | 44.8157 |
| 1350 | 105.0 | .06397 | | 48 | 6.2 | 0.7924 | 1.81 | 37.6342 | 46.6842 |
| | 64.0 | | | | 106.5 | 2.0273 | | 39.8695 | 48.9195 |
| 1300 | 90.0 | | | | 64.4 | 1.8089 | 1.76 | 38.3836 | 47.1836 |
| 1200 | 150.0 | | | | 41.5 | 1.6180 | 1.66 | 35.8860 | 44.1860 |
| | 139.0 | | | | 72.5 | 1.8603 | | 36.2882 | 44.5882 |
| 1350 | 105.0 | .09506 | | 48 | 11.0 | 1.0414 | 1.81 | 38.0849 | 47.1349 |
| | 64.0 | | | | 169.0 | 2.2279 | | 40.2325 | 49.2825 |
| 1300 | 90.0 | | | | 115.0 | 2.0607 | 1.76 | 38.8268 | 47.6268 |
| 1200 | 160.5 | | | | 33.5 | 1.5250 | 1.66 | 35.7316 | 44.0316 |
| | 150.0 | | | | 63.1 | 1.8000 | | 36.1880 | 44.4880 |
| | 139.0 | | | | 112.1 | 2.0496 | | 36.6023 | 44.9023 |
| 1350 | 105.0 | .0499 | | 36 | 26.8 | 1.4280 | 1.81 | 38.7849 | 47.8349 |
| | 82.5 | .0495 | | | 97.3 | 1.9881 | | 39.7985 | 48.8485 |
| 1300 | 106.4 | .0495 | | | 101.9 | 2.0082 | 1.76 | 38.7344 | 47.5344 |
| 1200 | 150.0 | | | | 131.1 | 2.1176 | 1.66 | 36.7152 | 45.0152 |
| | 154.2 | | | | 114.5 | 2.0588 | | 36.6176 | 44.9176 |
| 1350 | 105.0 | | | 48 | 12.0 | 1.0792 | 1.81 | 38.1553 | 47.2033 |
| | 75.6 | .0499 | | | 123.9 | 2.0931 | | 39.9885 | 49.0385 |
| 1300 | 93.0 | .0495 | | | 180.5 | 2.2565 | 1.76 | 39.1714 | 47.9714 |
| 1200 | 161.6 | | | | 75.8 | 1.8797 | 1.66 | 36.3203 | 44.6203 |
| | 150.0 | .0503 | | | 159.3 | 2.2022 | | 36.8557 | 45.1557 |

TABLE II

| TEST TEMP. °F. | TEST STEEL | AREA in$^2$ | Stud Tensile Strength Aged 1300° F. - 4 hours 36% Cold Work: LOAD POUNDS | STRESS psi | | |
|---|---|---|---|---|---|---|
| 70 | 5/16" studs | .06397 | 16,220 | 253,556 | 16,180 ± 57 | 252,930 ± 885 |
| | | | 16,140 | 252,305 | | |
| 1100 | | | 13,720 | 214,476 | 13,570 ± 212 | 212,131 ± 3316 |
| | | | 13.420 | 209,786 | | |
| 1200 | | | 13,820 | 216,039 | 13,730 ± 127 | 214,632 ± 1990 |

TABLE II-continued

| TEST TEMP. °F. | TEST STEEL | AREA in² | Stud Tensile Strength Aged 1300° F. - 4 hours 36% Cold Work LOAD POUNDS | STRESS psi | | |
|---|---|---|---|---|---|---|
| | | | 13,640 | 213,225 | | |
| 1350 | | | 12,840 | 200,719 | 12,670 ± 240 | 198,062 ± 3758 |
| | | | 12,500 | 195,404 | | |
| 70 | ⅜" studs | .09506 | 25,025 | 263,255 | 24,762 ± 371 | 260,494 ± 3905 |
| | | | 24,500 | 257,732 | | |
| 1100 | | | 20,050 | 210,919 | 19,800 ± 354 | 208,289 ± 3719 |
| | | | 19,550 | 205,659 | | |
| 1200 | | | 20,150 | 211,971 | 20,050 ± 141 | 210,919 ± 1488 |
| | | | 19,950 | 209,867 | | |
| 1350 | | | 19,475 | 204,871 | 19,462 ± 18 | 204,739 ± 186 |
| | | | 19,540 | 204,608 | | |

TABLE III

| TEST TEMP. °F. | UTS | .2% YS | E | RA. | Specimen Tensile Properties Aged 1300° F. - 4 hours 36% Cold Work UTS | .2% YS | ELONG. | RED. OF AREA |
|---|---|---|---|---|---|---|---|---|
| 70 | 253,507 | 242,485 | 14.0 | 42.6 | 242,441 + 29,585 | 226,625 + 36,044 | 16.7 + 5.5 | 47.7 + 5.5 |
| | 208,918 | 185,371 | 23.0 | 53.5 | | | | |
| | 264,898 | 252,020 | 13.0 | 46.9 | | | | |
| 1100 | 213,131 | 196,969 | 12.0 | 34.0 | 204,912 + 11,623 | 188,414 + 12,098 | 14.5 + 3.5 | 35.6 + 2.2 |
| | 196,692 | 179,860 | 17.0 | 37.1 | | | | |
| 1200 | 216,364 | 197,980 | 11.0 | 33.3 | 212,390 + 5,619 | 193,679 + 6,082 | 13.0 + 2.8 | 37.7 + 6.2 |
| | 208,417 | 189,379 | 15.0 | 42.0 | | | | |
| 1350 | 194,949 | 16,192 | 10.0 | 20.4 | 194,769 + 255 | 170,768 + 2,230 | 10.5 + 0.7 | 21.7 + 1.8 |
| | 194,589 | 172,345 | 11.0 | 23.0 | | | | |

A comparison of the properties of the alloys of the Smith patent, my earlier patent and the present invention are set out hereafter on the attached table:

TABLE IV

| Treatment | Smith 3,356,542 | | | Slaney 3,767,385 | | | Present Invention | | |
|---|---|---|---|---|---|---|---|---|---|
| % Cold Work | 51% | | | 48% | | | 36% | | |
| Age | 1050° F. | | | 1225° F. | | | 1300° F. | | |
| Properties | Room Temp. | 1200° F. | 1300° F. | Room Temp. | 1200° F. | 1300° F. | Room Temp. | 1200° F. | 1300° F. |
| Ultimate Tensile Strength (KSI)* | 310 | Not Suitable | Not Suitable | 275 | 222 | Not Suitable | 242.4 | 212.4 | 194.8 |
| 0.2 Yield Strength (KSI) | 290 | Above | Above | 265 | 210 | Above | 226.6 | 193.7 | 170.8 |
| Elongation | 11 | 800° F. | 800° F. | 8 | 7 | 1100° F. | 16.7 | 13.0 | 10.5 |
| Reduction in Area | 52 | | | 35 | 22 | | 47.7 | 37.7 | 21.7 |
| Stress Rupture | | Not Suitable Above 800° F. | | | Not Suitable Above 1100° F. | | 106.4 KSI @ 1300° F. 101.9 hrs. 96.0 KSI @ 1300 ° F. 98.2 hrs. 96.0 KSI @ 1300° F. 79.1 hrs. | | |

*KSI = kilopounds/in² = 1,000 psi

From the foregoing data it can be seen that this invention provides unique thermomechanical properties at temperatures in the neighborhood of 1300° F. where presently available alloys are no longer serviceable. This provides service temperatures for jet engine fasteners and other parts for higher temperature service, thus making it possible to construct such engines and other equipment for higher operating temperatures and greater efficiency than heretofore possible.

In the foregoing specification I have set out certain preferred practices and embodiments of this invention, however, it will be understood that this invention may otherwise be embodied within the scope of the following claims.

I claim:

1. A nickel-cobalt alloy having high strength and ductility at service temperatures of about 1300° F. consisting essentially of the following elements by weight percent:

| | |
|---|---|
| Carbon | about 0.05 max |
| Cobalt | about 20–40 |
| Molybdenum | about 6–11 |
| Chromium | about 15–23 |
| Iron | about 1.0 max |
| Boron | about 0.0005–0.020 |
| Titanium | about 0–6 |
| Columbium | about 1.1–10 |
| Nickel | Bal. |

and having a maximum electron vacancy number ($N_v$) of 2.80, said alloy having been cold worked at a temperature below the lower temperature limit of the HCP-FCC phase transformation zone to a reduction in cross-section between 5% and 50%.

2. A nickel-cobalt alloy as claimed in claim 1 having been cold worked to a reduction in cross-section between 10% and 40%.

3. A nickel-cobalt alloy as claimed in claim 1 or 2 having been aged at a temperature of about 800° F. to 1350° F. for about 4 hours after cold working.

4. A nickel base alloy as claimed in claim 1 or 2 having the composition by weight percent of:

| | |
|---|---|
| Carbon | about 0.01 max. |
| Cobalt | about 36 |
| Molybdenum | about 7.5 |
| Chromium | about 19.5 |
| Iron | about 1.0 max. |
| Boron | about 0.01 |
| Titanium | about 3.8 |
| Columbium | about 1.1 |
| Nickel | Bal. |

5. A nickel base alloy as claimed in claim 4 having been aged at a temperature of about 800° F. to 1350° F. for about 4 hours after cold working.

6. A nickel cobalt alloy as claimed in claim 1 or 2 which has been cold worked at ambient temperature.

7. A nickel cobalt alloy as claimed in claim 3 which has been cold worked at ambient temperature.

8. A nickel cobalt alloy as claimed in claim 4 which has been cold worked at ambient temperature.

9. A nickel cobalt alloy as claimed in claim 5 which has been cold worked at ambient temperature.

10. A nickel cobalt alloy as claimed in claim 3 having been aged at about 1350° F. for about 4 hours after cold working.

11. A nickel cobalt alloy as claimed in claim 5 having been aged at 1350° F. for about 4 hours after cold working.

12. A nickel cobalt alloy as claimed in claim 7 having been aged at 1350° F. for about 4 hours after cold working.

13. A nickel cobalt alloy as claimed in claim 9 having been aged at 1350° F. for about 4 hours after cold working.

14. A nickel-cobalt base alloy as claimed in claim 1 or 2 having been cold worked to a reduction in cross-section of about 36%.

15. A nickel-base alloy as claimed in claim 4 having been cold worked to a reduction in cross-section of about 36%.

* * * * *